US006729287B2

(12) United States Patent
Hammer et al.

(10) Patent No.: US 6,729,287 B2
(45) Date of Patent: May 4, 2004

(54) CONNECTION BETWEEN A SHAFT END OF A GAS EXCHANGE VALVE IN AN INTERNAL COMBUSTION ENGINE AND A SLEEVE-SHAPED CONTROL PISTON ON A TAPPET

(75) Inventors: Uwe Hammer, Hemmingen (DE); Sevan Tatiyosyan, Sersheim (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/296,979

(22) PCT Filed: Mar. 27, 2002

(86) PCT No.: PCT/DE02/01125

§ 371 (c)(1),
(2), (4) Date: May 23, 2003

(87) PCT Pub. No.: WO02/079612

PCT Pub. Date: Oct. 10, 2002

(65) Prior Publication Data

US 2003/0177995 A1 Sep. 25, 2003

(30) Foreign Application Priority Data

Mar. 30, 2001 (DE) ..... 101 16 218

(51) Int. Cl.[7] ..... F01L 1/14

(52) U.S. Cl. ..... 123/90.48; 123/188.3; 123/188.5; 403/374.3; 403/374.4

(58) Field of Search ..... 123/90.48–90.58, 123/90.28–90.3, 90.24, 188.2–188.5; 74/579 R, 586, 593; 403/367, 368, 370, 374.3, 374.4

(56) References Cited

U.S. PATENT DOCUMENTS

| | | | | | |
|---|---|---|---|---|---|
| 5,003,940 | A | * | 4/1991 | Hixson | 123/90.54 |
| 5,213,072 | A | * | 5/1993 | Dohring | 123/90.48 |
| 5,231,959 | A | * | 8/1993 | Smietana | 123/90.12 |
| 5,701,930 | A | * | 12/1997 | Russell | 137/454.5 |
| 6,446,541 | B1 | * | 9/2002 | Eriksson | 92/140 |

FOREIGN PATENT DOCUMENTS

| | | |
|---|---|---|
| DE | 100 40 114 A | 2/2002 |
| FR | 931 101 A | 2/1948 |

* cited by examiner

*Primary Examiner*—Thomas Denion
*Assistant Examiner*—Kyle Riddle
(74) *Attorney, Agent, or Firm*—Ronald E. Greigg

(57) ABSTRACT

A connection between a shaft end of a gas exchange valve of an internal combustion engine and a sleevelike actuating piston of a valve actuator, has at least two shell-like key pieces, surrounding the shaft end and on whose radially outer circumferential surface there is a conically tapering portion, pointing away from a combustion chamber of the engine, and extending in complementary fashion to the cone angle of a radially inner conical portion of a conical fastening sleeve that includes the key pieces, and the conical fastening sleeve and the key pieces can be braced axially against one another. Protrusions and recesses engaging one another are provided on the radially inner circumferential surface of the key pieces and on the radially outer circumferential surface of the shaft end of the gas exchange valve. The conical fastening sleeve is formed by the actuating piston and the actuating piston and the key pieces have threaded portions that can be screwed into one another.

20 Claims, 2 Drawing Sheets

CONNECTION BETWEEN A SHAFT END OF A GAS EXCHANGE VALVE IN AN INTERNAL COMBUSTION ENGINE AND A SLEEVE-SHAPED CONTROL PISTON ON A TAPPET

CROSS-REFERENCE TO RELATED APPLICATIONS

This application is a 35 USC 371 application of PCT/DE 02/01125, filed on Mar. 27, 2002.

BACKGROUND OF THE INVENTION

1. Field of the Invention

The invention is directed to an improved connection between a shaft end of a gas exchange valve of an internal combustion engine and a sleevelike actuating piston of a valve actuator.

2. Description of the Prior Art

One connection of the type with which this invention is concerned, known from German Patent Disclosure DE 198 26 046 A1, with at least two shell-like key pieces, which surround the shaft end and are axially braced on the actuating piston, whose radially outer circumferential surface extends conically, and which are surrounded by a conical fastening sleeve whose radially inner circumferential surface extends in complementary fashion to the cone angle of the key pieces, and which is axially braced against these key pieces by a nut screwed onto the shaft end. On the radially inner circumferential surface of the key pieces, there is an annular protrusion, which engages an annular groove on the radially outer circumferential surface of the shaft end. The actuating piston is formed by a differential piston, which depending on the pressure exerted on its piston faces, located on its face end and pointing away from one another, can slide up and down inside a cylindrical housing of the valve actuator. Because of the relatively high number of components that have to be assembled, however, the resultant production cost of this connection is high, and moreover the connection is relatively large.

SUMMARY AND ADVANTAGES OF THE INVENTION

Because according the invention the conical fastening sleeve is formed by the actuating piston, this actuating piston has a dual function; on the one hand, the hydraulic actuating forces engage it, and on the other, it assures the axial bracing of the conical connection, and hence a separate conical fastening sleeve can be dispensed with. Moreover, the threaded portions serving to brace the conical connection are embodied according to the invention on the actuating piston and on the key pieces, so that a lock nut can also be disposed with. The consequently reduced number of connection components makes assembly easier and faster; moreover, this reduces the amount of space the connection requires; and finally, the weight of the connection is also reduced.

In an especially preferred provision, on both the actuating piston and a key sleeve composed of the key pieces and extending all the way around, there is a respective engagement face for a screwing tool, which face is embodied in such a way that simultaneous engagement by connections associated with the engagement faces is possible. The key pieces and the actuating piston can then be screwed together in a single operation. Moreover, the connection is easily accessible from the outside, remote from the combustion chamber, through an opening in the valve actuator housing.

Because the valve shaft need not project out of the opening for the sake of assembling the connection, it is possible in particular to use gas exchange valves with short shafts and hence with little mass inertia.

Another refinement provides that the connection is radially surrounded by the actuating piston, and a hydraulic region subjected to pressure fluid is disposed in a radially outer region of the actuating piston. The connection is not located in the pressure region, and so if the connection has to be loosened, for instance for repair purposes, the hydraulic circuit of the pressure region does not have to be opened.

Preferably, it is also provided that the key pieces viewed in the circumferential direction, adjoin one another seamlessly, i.e., without spacing, and together form a key sleeve extending all the way around, whose inside diameter is slightly greater than the outside diameter of the shaft end of the gas exchange valve, and that the protrusions and recesses engage one another with slight play. This creates a positive-engagement connection which has play and by means of which errors in concentricity between the valve seat and the guidance of the valve shaft can be compensated for. Moreover, rotary motions of the shaft end relative to the actuating piston are allowed. In that case, the known advantages of regular rotation of the gas exchange valve about its longitudinal axis, such as making valve wear uniform or keeping the valve seat free of deposits, can be attained without requiring that the actuating piston rotate along with the gas exchange valve, and thus the sealing function of the actuating piston is not impaired.

The actuating piston is preferably embodied in two parts and contains a closing piston near the combustion chamber and an opening piston remote from the combustion chamber, axially adjoining the closing piston and operating in the opposite direction from it, and the conical portion and the threaded portion are disposed on the opening piston.

In another embodiment, the actuating piston can also be embodied as a one-piece differential piston. In that case, the number of components is reduced further, and the length of the gas exchange valve can be even less, because the actuating piston can then be made comparatively shorter.

BRIEF DESCRIPTION OF THE DRAWINGS

Exemplary embodiments of the invention are explained in further detail herein below, with reference to the drawings, in which.

DESCRIPTION OF THE PREFERRED EMBODIMENTS

Figure 1:
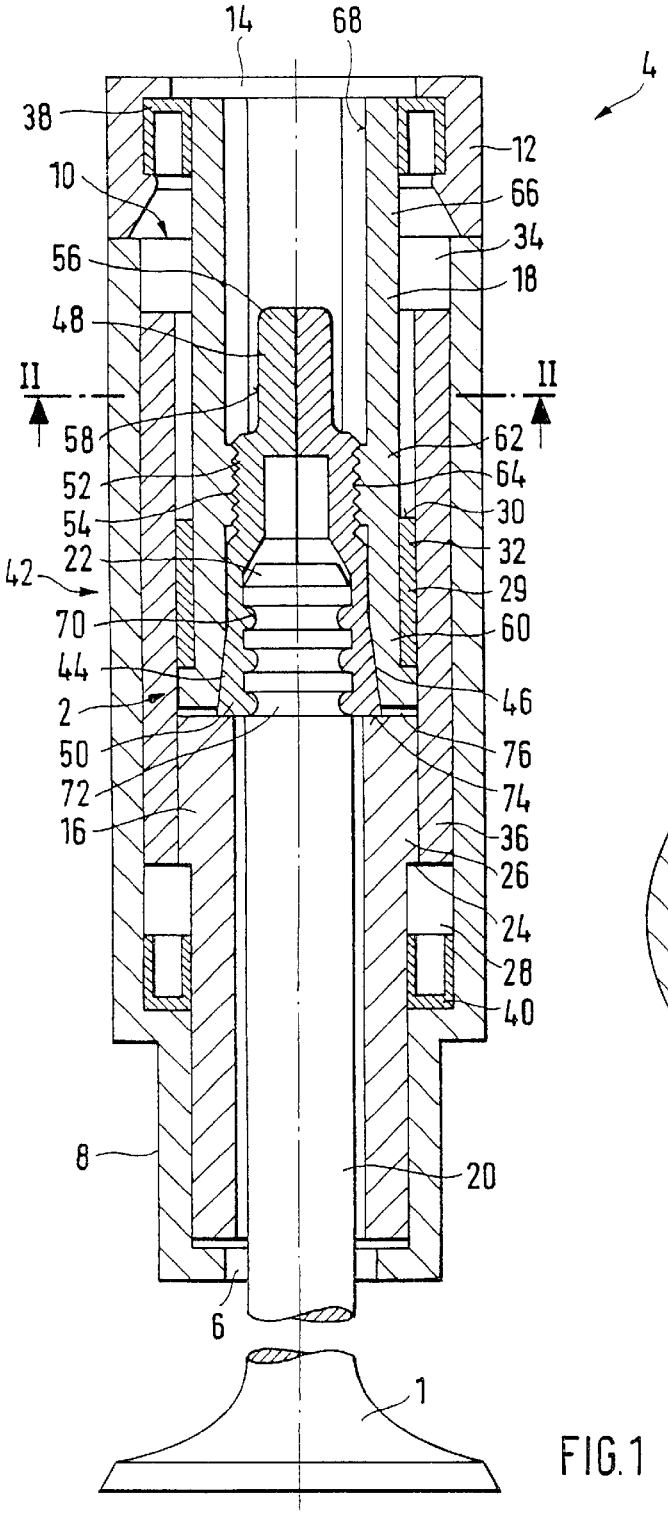
FIG. 1, a lateral cross-sectional view of a preferred embodiment of a connection according to the invention between a shaft end of a gas exchange valve of an internal combustion engine and an actuating piston of a valve actuator.

In FIG. 1, for reasons of scale, all that is shown of a valve drive of an internal combustion engine is a gas exchange valve 1, which is actuated by an actuating piston 2 of a valve actuator 4 in such a way that it executes upward and downward opening and closing motions.

The actuating piston 2 extends essentially from a bottom opening 6, toward the combustion chamber, in an actuator housing 8 of the valve actuator 4 to a bore 14 embodied in a cap 12 placed on an upper opening 10 if the actuator housing 8, and in the preferred embodiment the actuating piston includes two pistons, operating in contrary directions from one another: a sleevelike closing piston 16 toward the combustion chamber, and axially adjoining it, remote from the combustion chamber, an also- sleevelike opening piston 18. The closing piston 16 and the opening piston 18 surround a shaft 20 of the gas exchange valve 1 coaxially with radial play. The shaft 20 of the gas exchange valve 1 extends from a cylinder head, not shown, of the engine through the bottom opening 6 into the interior of the actuator housing 8, and one shaft end 22 is axially spaced apart from the bore 14 in the cap 12.

The closing piston 16, with an annular face 24 toward the combustion chamber, defines a first radially outer shoulder 26 of a lower work chamber 28, and a sleeve 29, slipped onto the opening piston 18, with an upper annular face 30 of a second radially outer shoulder 32, defines an upper work chamber 34; the work chambers 28, 34 can be filled with a pressure fluid or relieved through conduits not shown in FIG. 1. The two pistons 16, 18 are moreover guided axially by means of a bush 36 press-fitted into the actuator housing 8. A seal 38 in the region of the bore 14 of the cap 12 and a seal 40 in the region of the bottom opening 6 in the actuator housing 8 assure axial sealing of the two work chambers 28, 34.

A connection 42 between the shaft end 22 of the gas exchange valve 1 and the opening piston 18 includes two shell-like key pieces 44, 46, surrounding the shaft end 22, which together make up a key sleeve 48 extending all the way around, of which the radially outer circumferential surface of a portion 50 toward the combustion chamber tapers conically in a direction pointing away from the combustion chamber. This conical portion 50 of the key sleeve 48 is adjoined by a cylindrical portion 52 that has a male thread 54, which in turn ends with a portion 56 having an engagement face preferably embodied as a square end 58 for a screwing tool.

A radially inner circumferential surface of a portion 60, toward the combustion chamber, of the opening piston 18 extends in complementary fashion to the cone angle of the key sleeve 48; in addition, a threaded portion 62 axially adjoining this portion 60 is provided with a female thread 64 that can be screwed to the male thread 54 of the key sleeve 48. The threaded portion 62 of the opening piston 18 is adjoined by a cylindrical portion 66, radially spaced apart from the square end 58 of the key sleeve 48, which on its radially inner circumferential surface has an engagement face, preferably embodied as a hexagonal socket 68, for a screwing tool. The radial spacing of the square end 58 from the hexagonal socket 68 is great enough that a screwing tool can engage the square end 58.

On the radially inner circumferential surface of the key sleeve 48 and on the radially outer circumferential surface of the shaft end 22 of the gas exchange valve 1, protrusions 70 and recesses 72 that engage one another are provided, so as to create a positive-engagement connection 42. The connection 42 is radially surrounded by the opening piston 18 and is shielded by the opening piston from a radially outer hydraulic region that contains the lower and upper work chambers 38, 34.

In the preferred embodiment, the key sleeve 48 has three annular beads 70 in axial succession equidistant from one another on the radially inner circumferential surface of the conical portion, each annular bead extending in the circumferential direction, and each of these annular beads engages a respective annular groove 72 assigned to it that is disposed in the shaft end 22 and extends all the way around. The annular beads 70 and annular grooves 72 have an essentially semicircular cross section, and the inner radius of the annular grooves 72 is preferably a few hundredths of a millimeter larger than the outer radius of the annular beads 70.

Figure 2:
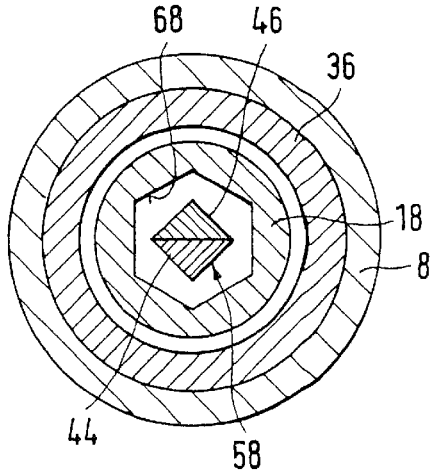
FIG. 2, a cross-section taken along the line II—II in FIG. 1.

In the assembly of the connection 42, first the actuator housing 8, still without its cap 12, is placed with the preassembled bush 36, preassembled closing piston 16 and preassembled seal 40, on the cylinder head of the engine, with the shaft 20 of the gas exchange valve 1 being introduced from below through the closing piston 16. Next, the two key pieces 44, 46 are placed on the shaft end 22, through the upper opening 10 in the actuator housing 8, and the opening piston 18 is screwed from the top onto the thus-formed key sleeve 48, with a square key wrench, as a means of preventing relative rotation, being placed on the square end 58 of the key sleeve 48, and at the same time a hexagonal key wrench is inserted into the hexagonal socket 68 in the opening piston 18, as can easily be imagined from FIG. 2. To enable simultaneous placement of the tools, the hexagonal key wrench must have a central through opening for the shaft of the square key wrench. As a result of the screwing motion, the key pieces 44, 46 are braced radially against each other by the wedging action, and because of the protrusions 70 and recesses 72 engaging one another by positive engagement the shaft end 22 is drawn into the conical portion 60 in the opening piston 28. An annular face 74, toward the combustion chamber and protruding radially past the shaft end 22, on the face end of the key sleeve 48 then forms an axial stop face for the closing piston 16, an between the closing piston and the opening piston 18 a narrow axial gap 76 remains, so that the two pistons 16, 18 are not joined to one another. Since as shown in FIG. 2 the key pieces 44, 46 adjoin one another seamlessly and flush in the circumferential direction and add up to make the key sleeve 48, which extends all the way around and whose inside diameter is slightly greater than the outside diameter of the shaft end 22 of the gas exchange valve 1, and since the protrusions 70 and recesses 72 likewise engage one another with play, a frictional contact between the circumferential surface of the shaft end 22 of the gas exchange valve 1 and the radially inner circumferential surface of the key sleeve 48 that would be sufficient to be able to prevent rotary motions of the shaft end 22 relative to the key sleeve 48 screwed to the opening piston cannot develop. As a result, the gas exchange valve 1 remains freely rotatable relative to the valve actuator 4. The difference in diameter between the inside diameter of the key sleeve 48 and the outside diameter of the shaft end 22 of the gas exchange valve 1 amounts preferably to a few hundredths of a millimeter. Finally, the cap 12, with the preassembled seal 38, is placed on the actuator housing 8.

In the light of the above, the function of the valve actuator 4 is as follows: To close the gas exchange valve 1, beginning in the open position shown in FIG. 1, the lower work chamber 28 is subjected to pressure fluid and at the same time the upper work chamber 34 is pressure-relieved, so that the closing piston 16 moves upward and, via the annular face 74 of the key sleeve 48 and the connection 42, carries the opening piston 18 along with it, so that the opening piston can move out of the bore 14 in the cap 12. Conversely, to open the gas exchange valve 1, the upper work chamber 34 is subjected to pressure and simultaneously the lower work chamber 28 is pressure-relieved, as a result of which the opening piston 18 being positively displaced downward carries the closing piston 16 along with it, via the connection 42 and the annular face 74 of the key sleeve 48. The flow of force from the opening piston 18 to the shaft end 22 is primarily via the protrusions 70 and recesses 72 meshing with one another by positive engagement, while the screwed-together threaded portions 52, 62 axially staggered relative to the protrusions and recesses serve solely to hold the key pieces 44, 46 together and thus are essentially not subjected to any dynamic stresses.

Figure 3:
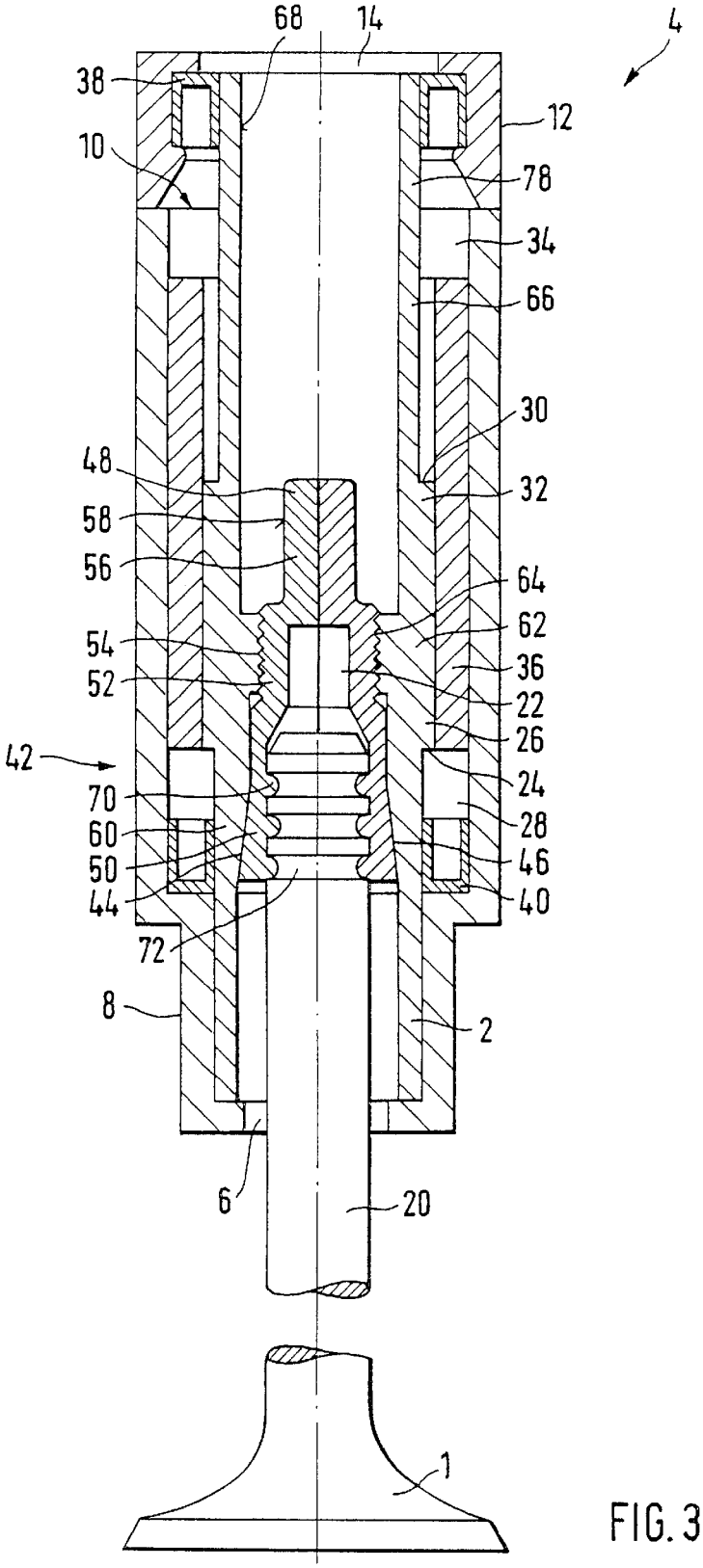
FIG. 3, a lateral cross-sectional view of a further embodiment of the connection according to the invention.

In the second exemplary embodiment of the invention shown in FIG. 3, those parts that remain the same and function the same as in the above example are identified by the same reference numerals. Unlike the exemplary embodiment described above, here the actuating piston 2 is embodied as a one-piece differential piston 78, which in the open position of the gas exchange valve 1 extends from the bottom opening 6, toward the combustion chamber, of the actuator housing 8 to the bore 14 in the cap 12.

The foregoing relates to preferred exemplary embodiments of the invention, it being understood that other variants and embodiments thereof are possible within the spirit and scope of the invention, the latter being defined by the appended claims.

We claim:

1. A connection (42) between a shaft end (22) of a gas exchange valve (1) of an internal combustion engine and a sleevelike actuating piston (2) of a valve actuator (4), the connection comprising at least two shell-like key pieces (44, 46) surrounding the shaft end (22) and having a conically tapering portion (50) on their radially outer circumferential surface pointing away from a combustion chamber of the engine, a conical fastening sleeve having a radially inner conical portion (60) surrounding the key pieces (44, 46) and having a cone angle complementary to the conical tapering portion (50), the conical fastening sleeve and the key pieces (44, 46) being braced axially against one another, and protrusions (70) and recesses (72) on the radially inner circumferential surface of the key pieces (44, 46) and on the radially outer circumferential surface of the shaft end (22) of the gas exchange valve (1), the protrusions and recesses engaging one another, the conical fastening sleeve being formed by the actuating piston (2) and the actuating piston (2) and the key pieces (44, 46) having threaded portions (52, 62) that can be screwed into one another.

2. The connection of claim 1 further comprising a respective engagement face (58,68) for a screwing tool formed on and extending all the way around on both the actuating piston (2) and a key sleeve (48) composed of the key pieces (44, 46), which engagement faces are embodied in such a way that simultaneous engagement by connections associated with the engagement faces (58, 68) is possible.

3. The connection of claim 2 wherein the conical portion (50), the threaded portion (52), and the engagement face (58) for the screwing tool are disposed axially one after the other on the key sleeve (48), in a direction pointing away from the combustion chamber.

4. The connection of claim 3 wherein the engagement face is embodied as a square male end (58), which is disposed with radial spacing from an engagement face of the actuating piston (2) that is embodied as a hexagonal socket (68).

5. The connection of claim 4 wherein the connection is radially surrounded by the actuating piston (2), and a hydraulic region (28, 34) subjected to pressure fluid is disposed in a radially outer region of the actuating piston (2).

6. The connection of claim 5 wherein the actuating piston (2) comprises an annular face (24) near the combustion chamber of a first radially outer shoulder (26) defining a lower work chamber (28) and an upper annular face (30) of a second radially outer shoulder (32) defining an upper work chamber (34), the work chambers (28, 34) being capable of being filled with a pressure fluid or relieved of the pressure fluid.

7. The connection of claim 6 wherein the actuating piston (2) is guided axially in a bush (36) retained in an actuator housing (8).

8. The connection of claim 7 wherein the actuating piston (2) is embodied in two parts and contains a closing piston (16) near the combustion chamber and an opening piston (18) remote from the combustion chamber, axially adjoining the closing piston and operating in the opposite direction from it, and wherein the closing piston (16) is associated with the lower work chamber (28) and the opening piston (18) is associated with the upper work chamber (34), the conical portion (60) and the threaded portion (62) being disposed on the opening piston (18).

9. The connection of claim 8 further comprising an annular face (74), near the combustion chamber, protruding radially past the shaft end (22) on the face end of the key sleeve (48), the annular face (74) forming an axial stop face for the closing piston (16), the opening piston (18) extending essentially as far as this annular face (74).

10. The connection of claim 1 wherein the actuating piston (2) is embodied as a differential piston (78).

11. The connection of claim 2 wherein the actuating piston (2) is embodied as a differential piston (78).

12. The connection of claim 3 wherein the actuating piston (2) is embodied as a differential piston (78).

13. The connection of claim 5 wherein the actuating piston (2) is embodied as a differential piston (78).

14. The connection of claim 6 wherein the actuating piston (2) is embodied as a differential piston (78).

15. The connection of claim 8 wherein the actuating piston (2) is embodied as a differential piston (78).

16. The connection of claim 1 wherein the key pieces (44, 46), viewed in the circumferential direction, adjoin one another seamlessly and together form a key sleeve (48) extending all the way around, the inside diameter of the key sleeve being slightly greater than the outside diameter of the shaft end (22) of the gas exchange valve (1), and wherein the protrusions (70) and recesses (72) engage one another with slight play.

17. The connection of claim 2 wherein the key pieces (44, 46), viewed in the circumferential direction, adjoin one another seamlessly and together form a key sleeve (48) extending all the way around, the inside diameter of the key sleeve being slightly greater than the outside diameter of the shaft end (22) of the gas exchange valve (1), and wherein the protrusions (70) and recesses (72) engage one another with slight play.

18. The connection of claim 3 wherein the key pieces (44, 46), viewed in the circumferential direction, adjoin one another seamlessly and together form a key sleeve (48) extending all the way around, the inside diameter of the key sleeve being slightly greater than the outside diameter of the shaft end (22) of the gas exchange valve (1), and wherein the protrusions (70) and recesses (72) engage one another with slight play.

19. The connection of claim 5 wherein the key pieces (44, 46), viewed in the circumferential direction, adjoin one another seamlessly and together form a key sleeve (48) extending all the way around, the inside diameter of the key sleeve being slightly greater than the outside diameter of the shaft end (22) of the gas exchange valve (1), and wherein the protrusions (70) and recesses (72) engage one another with slight play.

20. The connection of claim 10 wherein the key pieces (44, 46), viewed in the circumferential direction, adjoin one another seamlessly and together form a key sleeve (48) extending all the way around, the inside diameter of the key sleeve being slightly greater than the outside diameter of the shaft end (22) of the gas exchange valve (1), and wherein the protrusions (70) and recesses (72) engage one another with slight play.

* * * * *

UNITED STATES PATENT AND TRADEMARK OFFICE

CERTIFICATE OF CORRECTION

PATENT NO. : 6,729,287 B2
DATED : May 4, 2004
INVENTOR(S) : Uwe Hammer et al.

It is certified that error appears in the above-identified patent and that said Letters Patent is hereby corrected as shown below:

Title page,
Item [54], Title should read as follows:
-- [54] CONNECTION BETWEEN A SHAFT END OF A GAS EXCHANGE VALVE IN AN INTERNAL COMBUSTION ENGINE AND A SLEEVELIKE ACTUATING PISTON OF A VALVE ACTUATOR --

Signed and Sealed this

Twenty-ninth Day of June, 2004

JON W. DUDAS
*Acting Director of the United States Patent and Trademark Office*